US006945818B2

(12) United States Patent
Yamane

(10) Patent No.: US 6,945,818 B2
(45) Date of Patent: Sep. 20, 2005

(54) COAXIAL CONNECTOR

(75) Inventor: Masahiro Yamane, c/o Hirose Electric Co., Ltd. 5-23 Oosaki 5-chome, Shinagawa-ku, Tokyo (JP)

(73) Assignee: Masahiro Yamane, Tokyo (JP)

( * ) Notice: Subject to any disclaimer, the term of this patent is extended or adjusted under 35 U.S.C. 154(b) by 9 days.

(21) Appl. No.: 10/901,075

(22) Filed: Jul. 29, 2004

(65) Prior Publication Data

US 2005/0032421 A1 Feb. 10, 2005

(30) Foreign Application Priority Data

Aug. 8, 2003 (JP) ..... 2003-290122

(51) Int. Cl.[7] ..... H01R 9/05

(52) U.S. Cl. ..... 439/582; 439/694; 439/881; 439/902

(58) Field of Search ..... 439/582, 581, 439/578, 694, 881, 902

(56) References Cited

U.S. PATENT DOCUMENTS 5,037,329 A * 8/1991 Wright ..... 439/582
6,074,217 A * 6/2000 Maruyama et al. ..... 439/63
6,607,400 B1 * 8/2003 Ko ..... 439/581
6,692,286 B1 * 2/2004 De Cet ..... 439/352
6,837,743 B2 * 1/2005 Ko ..... 439/582
6,860,761 B2 * 3/2005 Lee et al. ..... 439/582

FOREIGN PATENT DOCUMENTS

EP 0252218 A1 * 1/1988 ..... 439/582
JP 8-37062 2/1996
JP 2002-170638 6/2002

* cited by examiner

*Primary Examiner*—Tho D. Ta
(74) *Attorney, Agent, or Firm*—Takeuchi & Takeuchi

(57) ABSTRACT

The coaxial connector connects between a first coaxial cable and a second coaxial cable by connecting between a first terminal connected to a first coaxial cable and a second terminal connected to a second coaxial cable. Both first and second terminals have a connecting means in a direction crossing the axial direction of each coaxial cable. The connecting means of the first terminal and the connecting means of the second terminal are connected by directly connecting the first terminal with the second terminal in a direction crossing the axial direction. Here, the first terminal and the second terminal can be freely rotated with regard to each other even after the connection.

9 Claims, 6 Drawing Sheets

COAXIAL CONNECTOR

BACKGROUND OF THE INVENTION

1. Field of the Invention

The present invention relates to coaxial connectors, especially right-angle type coaxial connectors, which can be directly connected to each other.

2. Description of the Related Art

Coaxial connectors are comprised of, for example, a pair of a male connector and a female connector. Those connectors are generally classified into two types, i.e. straight type and right-angle type, according to their configuration.

In the straight type coaxial connector, the connecting means for electrically connecting between the male connector and the female connector, e.g. a connecting pin or a spring member, is respectively secured along the axial direction of the coaxial cable connected to each connector, so that the male connector and the female connector are connected to each other along the axial direction of the coaxial cables. FIG. 11 shows an example of a straight type coaxial connector 9. Here, the reference numeral 91 indicates the female connector, and 92 indicates the male connector.

On the other hand, in the right-angle coaxial connector, the connecting means for connecting between the male connector and the female connector are secured along a direction perpendicular to the axial direction of the coaxial cable connected to each connector, so that the male connector and the female connector are connected to each other in a direction perpendicular to the axial direction of each coaxial cable.

Here, as disclosed in Japan Unexamined Patent Publication No. 2002-170638, the right-angle type coaxial connector is conventionally used to connect with a relay board. In this connector, the male connector and the female connector are not directly connected to each other without a relay board, which is usual for the straight type coaxial connector.

Coaxial connectors have been widely used in various technological fields. For example, they are used when a notebook type personal computer is manufactured. Conventionally, a notebook type personal computer has been manufactured by first mounting a coaxial cable only in a display unit or in an operation unit, connecting male connector or female connector to one end of the coaxial cable extending from the outside of the unit, and connecting the connector with a substrate that is mounted in the other unit and is connected to the other connector, while manufacturing the other members.

Japan Unexamined Patent Publication No. H8-37062 discloses so-called straight type coaxial connectors.

Japan Unexamined Patent Publication No. 2002-170638 discloses so-called right-angle type coaxial connectors connected via a relay board.

Since the male connector and the female connector are connected to each other along the axial direction of the coaxial cable in case of a straight type coaxial connector, if the coaxial cable is pulled in the axial direction, the tensile force will directly affect the connection between the male connector and the female connector. In order to be resistant to the tensile force, the coaxial connector usually has to have a complete locking mechanism between the male connector and the female connector. However, such complete locking mechanism has such drawbacks as requiring larger connectors, more specifically, a larger connecting section (larger diameter of the engaging section). Especially when the diameter of the coaxial cable to be connected to each connector is small, the coaxial connector becomes extremely larger in comparison with the coaxial cable, and therefore larger casing space is required for the coaxial connector connected to the coaxial cable, even though the coaxial cable itself does not require a large casing space.

In addition, for example, when the above-described notebook type personal computer is used, the male connector and the female connector used for connecting between the display unit and the operation unit are eventually completely cased in the display unit or in the operation unit. Since the straight type coaxial connector is relatively long in the axial direction, a casing space has to be relatively long in the specified direction to case such connector. In addition, it is difficult to change the direction of the coaxial cable in the casing space, so that the work of mounting the coaxial cable in the operation unit is troublesome. Moreover, since it is difficult to change the direction of the coaxial cable, the coaxial cable cannot be mounted especially in a small casing space if the coaxial cable is too long. Also, there is such another problem that undesired force applied in the axial direction will negatively affect the coaxial cable. Furthermore, if the casing space is relatively small, there may be a difficulty of changing the length of the coaxial cable.

SUMMARY OF THE INVENTION

In view of the above-described problems, the objective of the present invention is to provide a coaxial connector that has a short connecting length and can be cased in a relatively small space.

Another objective of this invention is to provide a coaxial connector, whereby the direction of the coaxial cable can be easily changed and the damage on the cable in the axial direction can be reduced.

Still another objective of this invention is to provide a coaxial connector, whereby the length of the coaxial cable can be freely and easily changed even in a relatively small casing space by using it as a joint or extension.

In order to achieve the above objectives, the coaxial connector of the present invention is a right-angle type coaxial connector that can be directly connected, especially the one that consists of a right-angle male connector and female connector and is used by directly connecting between the male and female connectors.

The present invention relates to a coaxial connector for electrically connecting between a first coaxial cable and a second coaxial cable by electrically connecting a first connector connected to the first coaxial cable with a second connector connected to the second coaxial cable. In this coaxial connector, the first connector has a connecting means in a direction crossing the axial direction of the first coaxial cable, and the second connector has a connecting means in a direction crossing the axial direction of the second coaxial cable. The connecting means of the first connector and the connecting means of the second connector are connected to each other by directly connecting the first and the second connectors in a direction crossing the axial direction. By this configuration, the coaxial connector can be cased in a relatively small space.

Here, in the above-described coaxial connector, the first connector and the second connector can be connected through cylindrical engaging sections. With this configuration, the first and the second connectors can be rotated with regard to each other even after the connection.

In addition, in the above coaxial connector, the main bodies of the first and the second connectors can be made by punching a thin metal sheet and then bending.

Furthermore, in the above coaxial connector, the connecting means of the first connector and the connecting means of the second connector can be connected to each other by connecting the first connector with the first coaxial cable extending outward from the inside of the first component, connecting the second connector with the second coaxial cable extending outward from the inside of the second component, and connecting the first connector with the second connectors. In this constitution, assembling of the first component and the second component is extremely easier.

In addition, in the above coaxial connector, the first connector and the second connector can be connected through a positioning means that is secured in the second component and interposed between the first and the second connectors. With this means, the first and the second connectors can be easily positioned.

In the above coaxial connector, the first component is either a display unit or an operation unit of the notebook type personal computer, and correspondingly, the second component is either the operation unit or the display unit of the notebook type personal computer.

In the above coaxial connector, a protrusion can be provided on a part of the outer surface of the cylindrical engaging section of the second connector. With this protrusion, the coaxial cable can be easily positioned when the coaxial cable is mounted in the main body of the connector. Here, this protrusion can be also used for preventing excess deep engagement between the first and the second connectors.

Also, in the above coaxial connector, the main body of the second connector can have a cylindrical engaging section formed by punching a thin metal sheet and then rolling into a tube, and the convex section formed on the engaging section of the metal sheets can be engaged with the concave section of the member to be attached to the main body. With this configuration, the unrolling of the engaging section of the metal sheet can be prevented.

In addition, the present invention is the notebook type personal computer wherein the connecting means of the first connector and the connecting means of the second connector are connected to each other by connecting the first connector to the first coaxial cable extending outward from the inside of the display unit of the notebook type personal computer, connecting the second connector with the second coaxial cable extending outward from the inside of the operation unit of the notebook type personal computer, and connecting the first and the second connectors outside of the notebook type personal computer. The first connector has the connecting means in a direction crossing the axial direction of the first coaxial cable, and the second connector has the connecting means in a direction crossing the second coaxial cable. The connecting means of the first connector and the connecting means of the second connector are connected to each other by directly connecting between the first and the second connectors in a direction crossing the axial direction. With this construction, assembling of the notebook type personal computer becomes extremely easy.

Furthermore, the present invention is the notebook type personal computer, in which the connecting means of the first connector and the connecting means of the second connector are connected to each other by connecting the first connector with the first coaxial cable extending outward from the inside of the display unit of the notebook type personal computer, and connecting the second connector with the second coaxial cable extending outward from the inside of the operation unit of the notebook type personal computer. The second connector is secured in the operation unit (second component), and the connecting means of the first connector and the connecting means of the second connector are connected in the operation unit (second component). The first connector has the connecting means in a direction crossing the axial direction of the first coaxial cable, and the second connector has the connecting means in a direction crossing the axial direction of the second coaxial cable. The connecting means of the first connector and the connecting means of the second connector are connected to each other by connecting the first connector with the second connectors in a direction crossing the axial direction. With this construction, assembling of the notebook type personal computer becomes extremely easy.

In addition, the present invention is the connectors which are coaxial connectors to electrically connect one coaxial cable with the other coaxial cable by connecting one connector electrically connected to one coaxial cable with the other connector electrically connected with the other coaxial cable. This connector has the connecting means in a direction crossing the axial direction of the coaxial cable, and the connecting means of the respective connectors are connected to each other by directly connecting those connectors in a direction crossing the axial direction.

The coaxial connector of this invention has longer connecting length, and can be cased in a relatively small space.

In the connector of this invention, the direction of the coaxial cable secured to the coaxial connector can be freely changed, and therefore it hardly receives undesired force in the axial direction, and also permissible length of the coaxial cable is larger.

BRIEF DESCRIPTION OF THE DRAWINGS

FIG. 9(*b*) shows another way of the connection;

DESCRIPTION OF THE PREFERRED EMBODIMENTS

Figure 1:
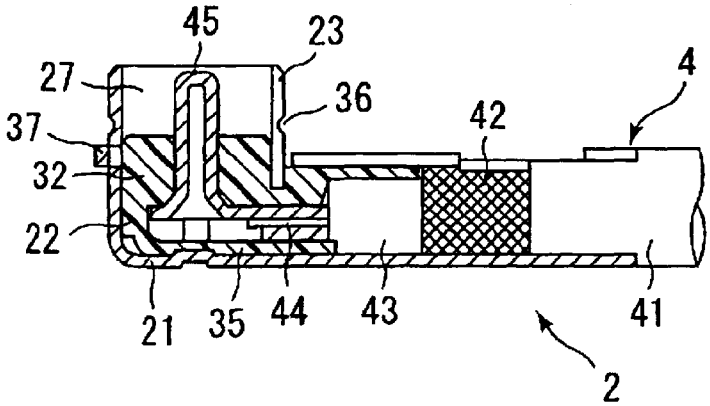
FIG. 1 is a cross-sectional side view of the male connector of the coaxial connector of this invention.
Figure 2:
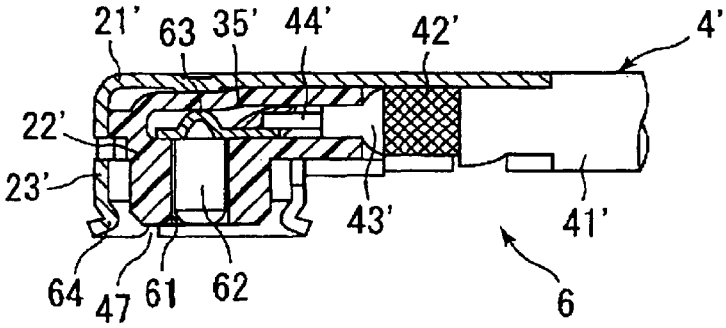
FIG. 2 is a cross-sectional side view of the female connector of the coaxial connector of this invention.
Figure 3:
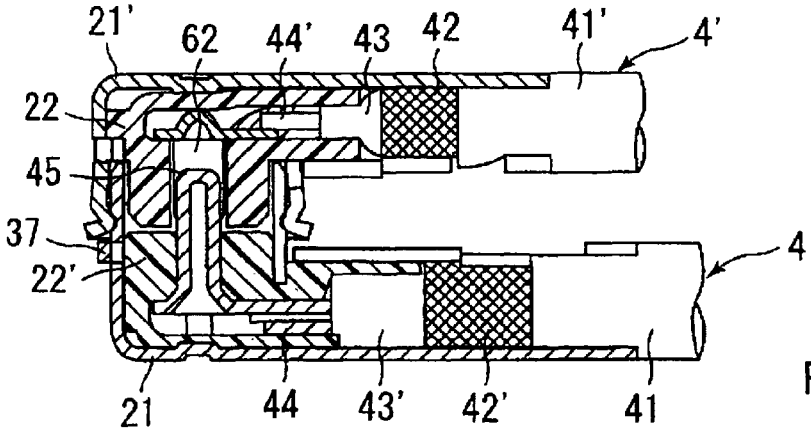
FIG. 3 is a cross-sectional side view of the male connector and the female connector of this invention when they are connected.
Figure 4A:
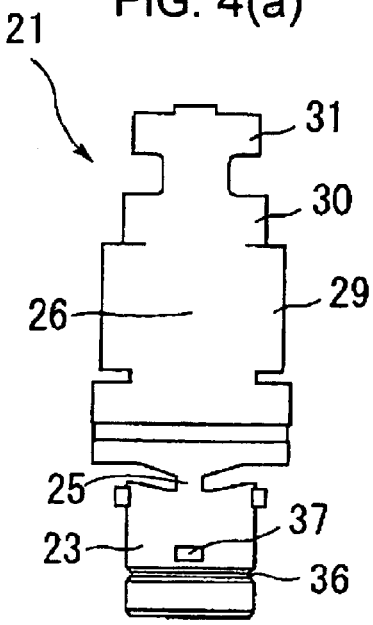
FIGS. 4(*a*)–(*d*) show the shield case before assembling.
Figure 4B:
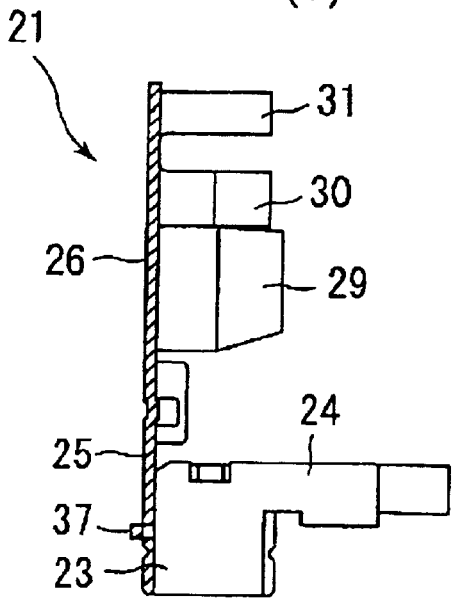
Figure 4C:
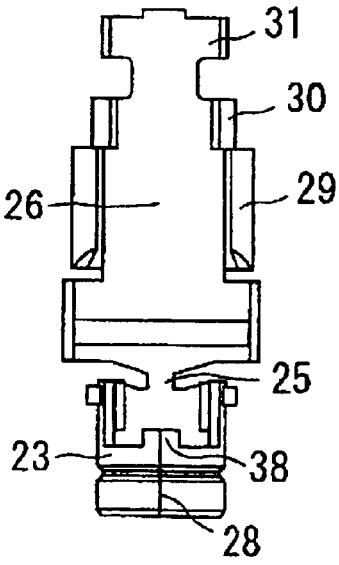
Figure 4D:
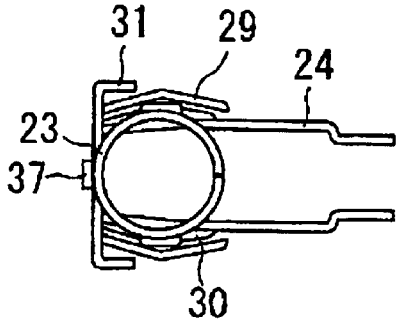

FIGS. 1–3 show the right-angle type coaxial connector according to this invention. FIG. 1 is a cross-sectional side view of the male connector of the coaxial connector. FIG. 2 is a cross-sectional side view of the female connector. FIG. 3 is a cross-sectional side view illustrating when the male connector and the female connector are connected.

Constitution of the Male Connector

First, the constitution of the male connector is described below. The male connector 2 has L-shape as a whole, and comprised of a shield case (plug-type outer conductor) 21 that forms the outer portion of the main body and a terminal insulator 22. A center contact 45 that forms a center conductor and the coaxial cable 4 are secured to the above members.

It is not obvious from the figures, but the shield case 21 is made by punching a thin metal sheet and then bending. Since cutting process is not included to prepare the shield case 21, the male connector 2 can be easily manufactured at reasonable cost. FIG. 4 illustrates the shield case before assembling the male connector 2. FIGS. 4(*a*), 4(*b*), 4(*c*) and 4(*d*) are the front view, cross-sectional view, back view, and bottom view of the shield case 21, respectively.

The shield case 21 comprises a cylindrical section 23 which works as an engaging section, a side surface section 24 extending generally in the vertical direction from the cylindrical section 23, an extended section 26 that is connected to the cylindrical section 23 via a narrow section 25 and extends horizontally from the cylindrical section 23. The extended section 26 has a coaxial cable insulator crimping section 29, a shield conductor crimping section 30 and an outer coating crimping section 31, which respectively extends in generally vertical direction to the extended section 26.

Cylindrical Section of the Shield Case

The cylindrical section 23 of the shield case has around its generally center on the back surface a overlapping section 28 which is formed when the metal sheet is rolled into a tube to form the cylindrical section 23. As easily understood, the two overlapping edge portions of the metal sheet overlapped to each other at the overlapping section 28 are formed by rolling a metal sheet into a tube, so that those overlapping edge portions of the metal sheet tend to be unrolled outward receiving load when the female connector is inserted/removed into/from the male connector. For this reason, in order to have those edge surfaces of the overlapping section 28 substantially completely attached to each other without misaligning them, the upper portion of the overlapping section 28 has a convex section 38 that can engage with the concave section of the terminal insulator 22 (39 in FIG. 5).

Annular concave section 36 is provided around the outer perimeter around the edge of the shield case cylindrical section 23 to lock the female connector.

A protrusion 37 used for positioning the coaxial cable with a tool (not illustrated) is provided near generally center of the outer perimeter of the cylindrical section 23 on the other side of the annular concave section 36 which is opposite to the edge of the cylindrical section 23 of the shield case on the front surface. Conventionally, such positioning of the coaxial cable has been done using a notch provided on a part of the shield case or the like (e.g. notch 47 provided on the shield case 21' of the female connector 6 in FIG. 2). However, for example, if the male connector and the female connector are engaged by fitting the female connector to the male connector that is already positioned, it is preferred to prevent the deformation of the male connector. In this case, it is not preferred to have a notch like the notch 47 provided on the female connector 6. Accordingly, in this invention, the protrusion is provided in place of the notch, so as to enable the positioning of the coaxial cables by engaging the male and female connectors so as to fit the protrusion 37. Here, as will be described below, this protrusion can also work as a stopper when the male connector engages the female connector.

The terminal insulator 22 is attached inside the shield case 21, and substantially completely cased therein. The terminal insulator 22 has a concave section 39 corresponding to the convex section 38 of the overlapping section 28 of the shield case 21. When the terminal insulator is to be attached to the shield case 21, the overlapping section is completely prevented from unrolling outward at least at the convex section 38 of the shield case 21 by engaging the concave section 39 of the terminal insulator 22 and the convex section 38 of the overlapping section 28 when the overlapping edge portions of the metal sheet are attached to each other at the overlapping section of the shield case 21. Here, once the terminal insulator 22 is attached to the shield case 21, the convex section 38 of the shield case 21 can be put together closely to the concave section 39 of the terminal insulator 22 using the force to unroll the overlapping edge portions of the metal sheet in the overlapping section of the shield case 21.

Coaxial Cable

At the end portion of the coaxial cable 4, the shield conductor inside the outer coating 41 of the coaxial cable 4 is exposed. At the very end of the coaxial cable 4, the outer coating 41, the shield conductor 42 and the coaxial cable insulator 43 are removed, so that the center conductor 44 is exposed. The exposed shield conductor 42 is electrically and physically connected to the shield case around the shield conductor 42. A pin-shaped center contact 45 is soldered to the exposed center conductor 44 in a direction crossing the axial direction of the coaxial cable, for example, a direction vertical to the axial direction. The coaxial cable 4 and the center contact 45 are attached inside the terminal insulator 22. The coaxial cable and the center contact 45 are positioned in the shield case via the terminal insulator 22. More specifically, the center conductor 44 of the coaxial cable 4 is positioned from both directions being interposed between the terminal insulators 22. On the other hand, the center contact 45 is positioned while projecting from the terminal insulator 22, more specifically, from the center of the cylindrical section of the terminal insulator.

Assembling Procedures

Figure 5A:
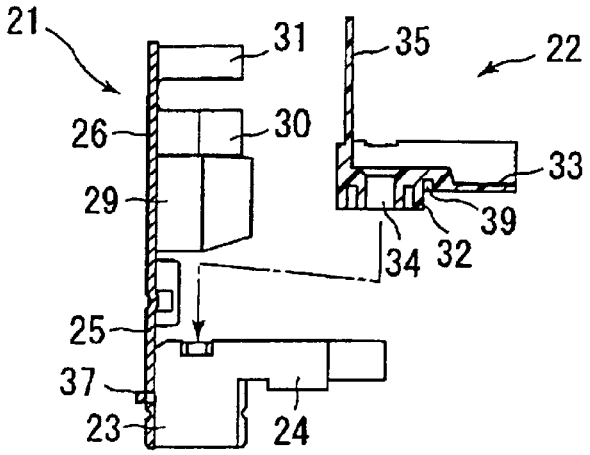
FIGS. 5(*a*)–(*c*) show a procedures for assembling the male connector.
Figure 5B:
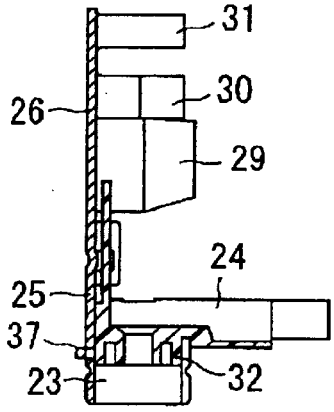
Figure 5C:
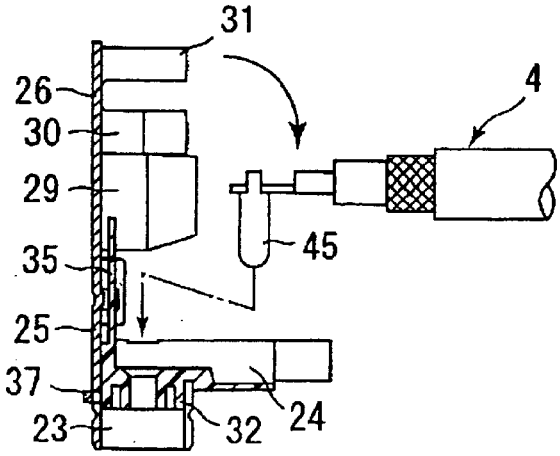

Referring now to FIG. 5, assembling procedure of the male connector will be described. FIG. 5 is a partial cross-sectional side view when the shield case is viewed from its front side.

As illustrated in FIGS. 5(*a*) and 5(*b*), the terminal insulator 22 is disposed in a specified position of the shield case 21. At this time, the convex section 38 of the shield case 21 is pressed into the concave section 39 of the terminal insulator 22. When the terminal insulator is completely attached to the shield case 21, the cylindrical section 32 of the terminal insulator 22 is inserted into a part of the cylindrical section 23 of the shield case 21, and generally whole side surface of the portion 33 extending from near the cylindrical section 32 of the terminal insulator 22 in the generally vertical direction is covered with the side surface of the shield case 24.

As shown in FIG. 5(*c*), the coaxial cable 4 is attached to the terminal insulator 22 by pressing the center contact 45 secured around the end of the coaxial cable 4 into a through hole 34 provided in the center of the cylindrical section 32 of the terminal insulator 22.

Thereafter, the extended section 26 of the shield case 21 is bent for 90 degrees around the narrow section 25 in the direction of the arrow (A) in the figure being closer to the cylindrical section 23 of the shield case. As a result, the upper side of the coaxial cable 4 is covered with the shield case 21. Then, the coaxial cable insulator crimping section 29, the shield conductor crimping section 30, and the outer coating crimping section 31, which extend from the extended section 26, are respectively bent so as to surround the side and the bottom surfaces of the coaxial cable, whereby the shield case is completely prepared.

Here, when the extended section 26 of the shield case 21 is bent, the extended section 35 of the terminal insulator 22 which is formed as a part of the terminal insulator 22 is also simultaneously bent. As a result, the extended section 35 of the terminal insulator 22 covers the upper side of the coaxial cable 4 in the shield case 21, and therefore electrical connection between the inner members of the coaxial cable 4, i.e. center conductor 44 and center contact 45, and the outer member, i.e. shield conductor 42, can be completely shielded.

Constitution of the Female Connector

In next, the constitution of the female connector will be described below. Similarly to the male connector 2 which is described above, the female connector 6 also has L-shape as a whole, and is comprised of a shield case 21' (socket-type outer conductor) that forms the outer part of the main body and a terminal insulator 22' disposed in the shield case 21'. A clamping spring 62 that forms the center conductor and the coaxial cable 4' are secured in the above members. Since the constitution of the female connector 6 is approximate to that of the male connector 2, only characteristic portions are described below. Here, members similar to those in the male connector are denoted "'" after the corresponding reference numerals.

The terminal insulator 22' of the female connector 6 extends substantially whole portion of the inside of the cylindrical section 23' of the shield case. Therefore, it does not have a shell section (the reference numeral 27 in FIG. 1) like the cylindrical section 23 of the shield case of the male connector 2. A contact inserting hole 61 is provided in the center of the terminal insulator 22', and a pair of planar clamping springs 62 is provided along the hole so as to be parallel to each other in the vertical direction on the paper. The upper portions of the clamping springs 62 are connected to a planar conductor 63 having a protruded section on its center. And the edge of the planar conductor 63 is soldered to the center conductor 44' of the coaxial cable.

Connection Between the Male Connector and the Female Connector

As is clear from FIG. 3, in this invention, the male connector and the female connector are directly connected to each other.

When the male connector 2 and the female connector 6 are connected, the annular convex section 64 provided near the edge of the cylindrical section 23' of the shield case of the female connector is fit into the annular concave section 25 provided near the edge of the cylindrical section 23 of the shield case of the male connector, making a clicking noise. At this time, both connectors can be connected, for example, by a simple lock such as a finger lock. In this case, since the protrusion 37 works as a stopper, damage of the male connector 2 or the female connector 6 due to deep engagement between the male connector and the female connector can be prevented. Here, a complete lock such as the one by threaded engagement is not necessary. This is because the male connector 2 and the female connector 6 are connected in a direction crossing the axial direction in this invention, which generates relatively strong connection in the axial direction. Therefore, the right-angle type coaxial connector of this invention can be satisfactory resistant to potentially applied tension, simply by using a small simple lock (or even without such locking mechanism).

When the male connector 2 and the female connector 6 are connected, a part of the end of the terminal insulator 22' of the female connector 6 engages the shell section 27 of the male connector 2. In addition, the center contact 45 of the male connector 2 is inserted between the clamping springs 62 being against the spring force. By doing this, the clamping spring 62 of the female connector 6 and the center contact 45 of the male connector 2, therefore the coaxial cable 4' connected to the clamping spring 62 of the female connector and the coaxial cable 4 connected to the center contact 45 of the male connector, are electrically connected to each other.

As is clear, since the male connector 2 and the female connector 6 are directly connected, the connection point is only one, and therefore deterioration of characteristics between the coaxial cables, such as reflection loss or transmission loss, can be reduced in comparison with when a relay board is used.

In addition, in this invention, since both male connector 2 and female connector 6 are connected in the axial direction of the coaxial cables 4 and 4', the dimension of the connection can be made compact, i.e. the dimension in a direction vertical to the axial direction of the coaxial cables 4 and 4' that are to be connected to each other can be made small, and therefore it can be cased in a relatively small space.

Furthermore, in this invention, the male connector 2 and the female connector 6 can be connected being freely rotatable by the cylindrical sections 23 and 23' of the shield case, which are cylindrical engaging sections of the respective connectors. There is no restriction in the rotational angle, and the connectors can be connected in any directions by rotating either of those connectors up to 360°. As a result, even when the length of the coaxial cable is too long to case in a small space, it can be cased therein by changing the direction of the coaxial cable without shortening the length of the coaxial cable and without damaging any part of the coaxial cable, as long as the length of the coaxial cable is within a certain range of length. Moreover, since the male connector 2 and the female connector 6 are freely rotatable, damage on the coaxial cable can be reduced by changing the direction of the coaxial cable even when undesired force, for example, a force whereby the male connector 2 and the female connector 6 are forced to press each other in the axial direction of the coaxial cables is applied. In addition, even when an undesired force whereby the male connector 2 and the female connector 6 are forced to press each other in a direction vertical to the axial direction of the coaxial cables is applied, the male connector will not engage excessively deeply into the female connector 6 because the protrusion 37 provided on the shield case of the male connector 2 collides with the cylindrical section 23' of the female connector 6.

Application to a Personal Computer

Figure 6:
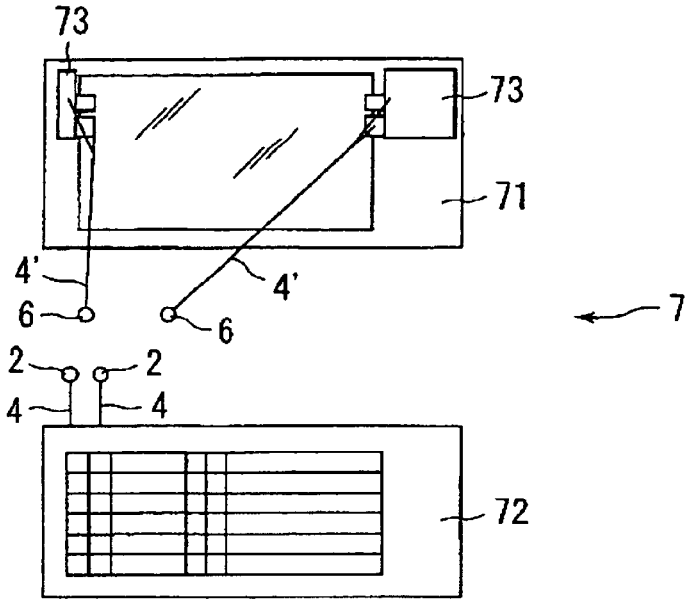
FIG. 6 is a conceptual view of the whole notebook type personal computer, illustrating the example of application of the coaxial connector of this invention to the notebook type personal computer.
Figure 7:
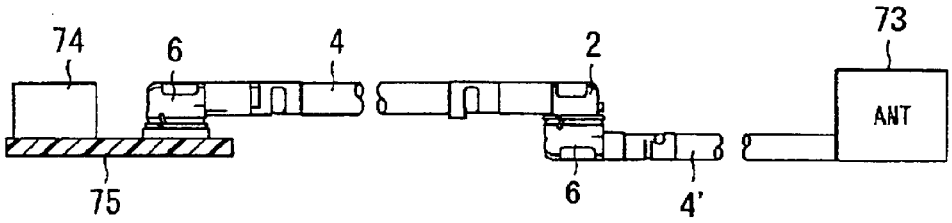
FIG. 7 is a conceptual view of the connection of the connectors, illustrating the example of application of the coaxial connector of this invention to the notebook type personal computer.

Referring now to FIGS. 6–11, examples of application of the coaxial connector of this invention to a notebook type personal computer are described below. FIGS. 6 and 7 are conceptual illustrations which show the examples of the application. FIG. 6 is a conceptual illustration which specially shows the whole view of the notebook type personal computer, and FIG. 7 is a conceptual illustration of the connection between the male connector 2 and the female connector 6.

As is clear from FIG. 6, when the notebook type personal computer 7 is manufactured using the coaxial connector 1 of this invention, the display unit 71 and the operation unit 72 are produced in separate production lines. The male connector 2 and the female connector 6 which are secured to the respective ends of the coaxial cable 4, 4' that extend outward from the inside of the display unit 71 and the operation unit 72, are connected outside the notebook type personal computer 7. Here, in FIG. 6, a diversity type display, a display unit 71 having two antennas 73, is shown.

When the male connector 2 and the female connector 6 are connected, for example, as shown in FIG. 7, the coaxial cable 4' directly extending from the antenna 73 provided at the display unit 71 side and the coaxial cable 4 connected to the device board 75 at operation unit 72 side, on which every device is arranged thereon, are electrically connected via the coaxial connector 1. Of course, as shown in the conceptual illustration of FIG. 7, a connector similar to the female connector 6 of this invention can be also used for the connection with the device board 75.

As is obvious, the methods shown in FIGS. 6 and 7 allow variations in manufacturing. According to the manufacturing methods, the display unit 71 and the operation unit 72 can be manufactured in completely separate production lines. For example, if various types of display unit 71 and operation unit 72 can be prepared in advance according to client's demands, various types of personal computers can be manufactured by combining different types of display unit 72 and operation unit 72 as necessary. In addition, according to the methods shown in FIGS. 6 and 7, the coaxial cable 4 provided on the display unit 71 side can be prepared so as to differ from the coaxial cable provided at the operation unit 72 side. For example, as shown in FIG. 7, the diameters of those coaxial cables can be differed. When there is enough internal space, it is preferred to prevent deterioration of transmission characteristics by enlarging the diameter of the coaxial cable. Of course, in the above embodiment, there is no restriction on selecting between male connector and female connector for the display unit 71 and the operation unit.

Figure 8A:
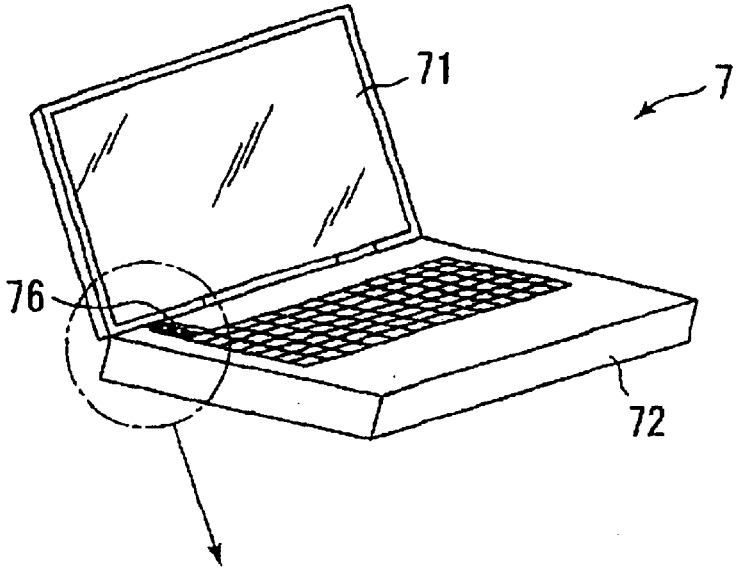
FIGS. 8(*a*)–(*b*) show an example of actual use of the coaxial connector of this invention in the notebook type personal computer.
Figure 8B:
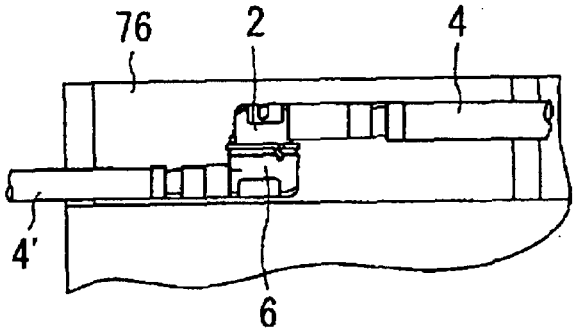
Figure 9A:
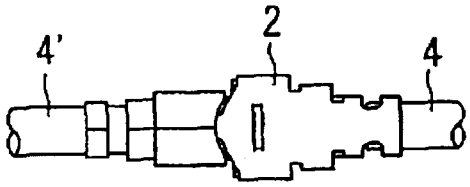
FIG. 9(*a*) is a top view of the connectors when connected.
Figure 9B:
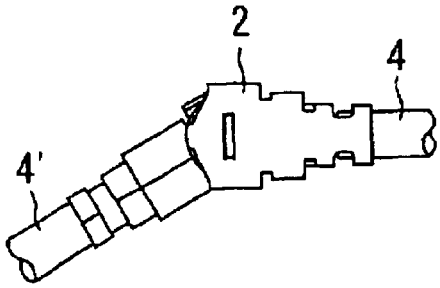

FIGS. 8 and 9 show examples of how to actually use the connectors in the notebook type personal computer 7. FIG. 8(*a*) shows when the coaxial connector is cased in the relatively small space provided at the operation unit side of the notebook type personal computer. FIG. 8(*b*) is a partially enlarged side view illustrating the coaxial connectors cased therein. FIG. 9 are the top views of the connectors of FIG. 8(*b*) illustrating how they are connected, and FIG. 9(*b*) shows modified way to connect the connectors.

As shown in FIG. 8(*a*), the coaxial connector 1 of this invention is eventually cased in the space 76 of the operation unit 72. Even in this case, as shown in FIG. 8(*b*), the male connector and the female connector are connected in a direction crossing the axial direction. Therefore, similarly to the straight type coaxial connector, the coaxial connector 1 can be cased in a relatively small space 76 as shown in the figure without requiring a space that is long in the specified direction (left-and-right direction in the figure). The connectors of FIG. 8(*b*) when they are viewed from the top side are shown in FIG. 9(*a*). In this connection, the connectors are connected pressing each other along the axial direction of the coaxial cables. However, in this invention, since the male connector 2 and the female connector are connected so as to be freely rotatable, they can be connected, for example, in a manner as shown in FIG. 9(*b*). Therefore, according to this invention, the direction of the coaxial cable can be freely changed and this change of the direction is effective especially when the space is small.

Figure 10A:
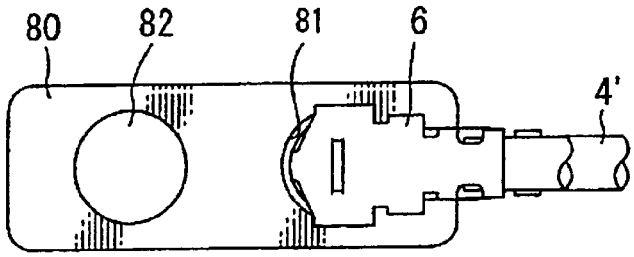
FIGS. 10(*a*)–(*b*) are an example of the positioning structure of the connectors.
Figure 10B:
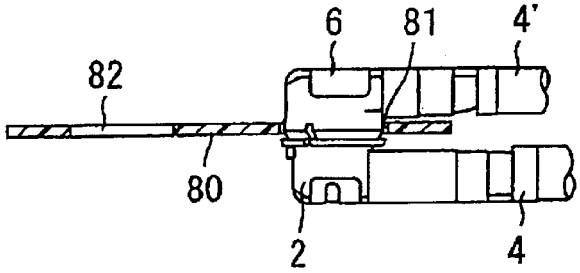
Figure 11:
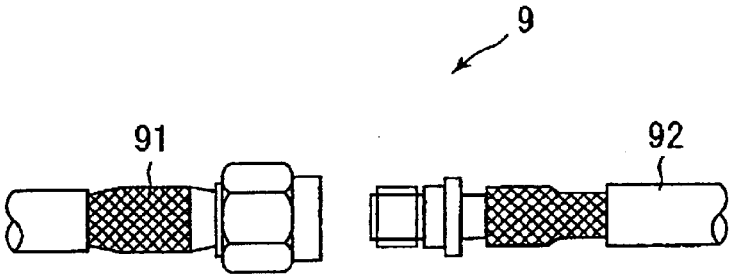
FIG. 11 PRIOR ART
FIG. 11 shows an example of the straight type coaxial connector.

Lastly, referring to FIG. 10, the positioning structure for the coaxial connector 1 in a specified space is described below. FIG. 10(*a*) is a top view of the positioning structure, and FIG. 10(*b*) is the side view of FIG. 10(*a*). Here, the positioning plate 80 made of a film or the like is used for positioning one of male connector 2 or female connector 6 in a specified position. The positioning plate 80 is secured in a relatively small space for disposing the male connector 2 and the female connector 6 therein. The positioning plate 80 has at least two holes 81 and 82, and the male connector 2 and the female connector 6 can be secured interposing one hole 81 between the connectors. The other hole 82 can be used for securing the positioning plate 80 in a specified position of the specified space by placing a screw into the hole 82.

For example, the male connector 2 is disposed in advance by fitting it into one hole 81 of the positioning plate 80 secured in the space, and then the female connector 6 is connected to the male connector 2 so as to interpose the positioning plate between the connectors. In this case, the positions of the male connector 2 and the female connector 6 in the space 76 can be determined by the positioning plate 80. Of course, the female connector 6 can be first disposed with the positioning plate 80 before the male connector 2. Here, the positioning plate does not have to be separately provided, but can be provided by making holes on the housing, the substrate or other part of the notebook type personal computer so as to determine the positions of the male connector 2 and the female connector 6.

Other Features

In the above embodiments, examples of applications of the present invention in the notebook type personal computer are described. However, of course, this invention is also applicable to a cellular phone or PDA, which has a display unit and an operation unit similarly to the notebook type personal computer, or various electronic devices which are comprised of a first component and a second component.

In addition, in the coaxial connector, the outer conductor and the center conductor can have either male or female configuration. Furthermore, the connection between the center connector and the coaxial cable does not have to be made by soldering, but can be made by crimping or other methods. In addition to electrical coaxial cables, the present invention can be easily used for optical cables as long as the cables are coaxial. Therefore, this invention is not limited to electrical connection.

Since the coaxial connector of this invention does not require so much space and its direction can be easily changed, it is effective when the coaxial connector needs to be cased in a relatively small space. Moreover, the coaxial connector of this invention can be used for relaying or extending the coaxial cables.

What is claimed is:

1. Coaxial connectors for connecting a first coaxial cable and a second coaxial cable, comprising:

a right-angle type male coaxial connector which is connected to said first coaxial cable and has a male connecting means extending at right angles with the axial direction of said first coaxial cable; and a right-angle type female coaxial connector which is connected to said second coaxial cable and has a female connecting means extending at right angles with the axial direction of said second coaxial cable, wherein said male connecting means of said male connector and said female connecting means of said female connector are connected to each other by directly connecting said male connector with said female connector at right angles with each axial direction;

wherein said male connecting means of said male connector and said female connecting means of said female connector are connected to each other by connecting said first coaxial cable to a first component, connecting said second coaxial cable to a second component, and connecting said male connector with said female connector so that said first and second components are connected in a limited space without substantial deterioration of electrical characteristics;

wherein said male connector and said female connector are connected to each other so as to interpose a positioning means between said male and said female connectors, wherein said positioning means is provided inside said second component.

2. The coaxial connector of claim 1, wherein said male connector and said female connector have an L-shaped main body made by punching and then bending a thin metal sheet and an L-shaped insulating body provided within said main body to hold part of said coaxial cable, thereby maximizing resistance to a pulling force.

3. The coaxial connector of claim 1, wherein said first component is either a display unit or an operation unit of a notebook type personal computer, and correspondingly, said second component is either the operation unit or the display unit of said notebook type personal computer.

4. The coaxial connector of claim 1, wherein said female connector has a spring cylindrical engaging section formed by punching a thin metal sheet and then rolling into a tube, and a convex section formed on an overlapping section of said metal sheet in the cylindrical engaging section for engagement with a concave section provided on a cylindrical engaging section of said male connector.

5. The coaxial connector of claim 1, wherein said male connector has a cylindrical engaging section and said female connector has a spring cylindrical engaging section into which said cylindrical engaging section is fitted.

6. The coaxial connector of claim 5, wherein said cylindrical engaging section of said male connector has a protrusion on a part of its outer surface.

7. A notebook type personal computer, comprising:

a display unit;

an operation unit;

a first type connector that is connected to a first coaxial cable extending outward from the inside of said display unit and has a first type connecting means in a direction crossing the axial direction of said first coaxial cable; and a second type connector that is connected to a second coaxial cable extending outward from the inside of said operation unit and has a second type connecting means in a direction crossing the axial direction of said second coaxial cable, wherein said first type connecting means of said first type connector and said second type connecting means of said second type connector are connected to each other by directly connecting said first and second type connectors in a direction crossing each axial direction outside said notebook type personal computer.

8. A notebook type personal computer, comprising:

a first unit;

a second unit;

a first type connector that is connected to a first coaxial cable extending outward from the inside of the first unit and has a first type connecting means in a direction crossing the axial direction of said first coaxial cable; and a second type connector that is secured in said second unit, is connected to a second coaxial cable extending outward from the inside of the second unit and has a second type connecting means in a direction crossing the axial direction of said second coaxial cable, wherein said first type connecting means of said first type connector and said second type connecting means of said second type connector are connected to each other by directly connecting said first type connector and said second type connector in a direction crossing each axial direction.

9. The notebook type personal computer according to claim 8, wherein said second type connecting means has a spring cylindrical section into which said first type connecting means is fitted.

* * * * *